United States Patent [19]

Eke

[11] Patent Number: 4,831,227

[45] Date of Patent: May 16, 1989

[54] MICROWAVE OVENS AND METHODS OF COOKING FOOD

[75] Inventor: Kenneth I. Eke, Woldingham, Great Britain

[73] Assignee: Microwave Ovens Limited, Croyden, England

[21] Appl. No.: 162,142

[22] Filed: Feb. 29, 1988

[30] Foreign Application Priority Data

Mar. 6, 1987 [GB] United Kingdom ..... 8705222
Oct. 24, 1987 [GB] United Kingdom ..... 8724938

[51] Int. Cl.[4] ..... H05B 6/68

[52] U.S. Cl. ..... 219/10.55 M; 219/10.55 B; 219/400; 99/325

[58] Field of Search ..... 219/10.55 B, 10.55 R, 219/10.55 E, 486, 400, 10.55 M; 99/325, 328, 329 R, 326, 451, DIG. 14

[56] References Cited

U.S. PATENT DOCUMENTS 3,569,656 3/1971 White et al. ..... 219/10.55 B
4,332,992 6/1982 Larsen et al. ..... 219/10.55 R
4,454,404 6/1984 Zushi ..... 219/10.55 B
4,508,947 4/1985 Eke ..... 219/10.55 B
4,533,809 8/1985 Eke ..... 99/325 X

*Primary Examiner*—Philip H. Leung
*Attorney, Agent, or Firm*—Penrose L. Albright; Robert A. Miller

[57] ABSTRACT

A microwave oven has a magnetron for delivering microwave power to the oven cavity, and a fan (36) and electrical resistance heating element (38) for recirculating hot air through the cavity. The oven cooks cakes by subjecting the cakes to a first cooking stage during which hot air but no microwave power is produced, and a second cooking stage during which microwave power is produced but the electrical resistance heating element (38) is not energized, and a third cooking stage during which hot air power is applied and microwave power is produced for a certain proportion of the third cooking stage. The transitions between the stages are determined by the recirculated air temperature as detected by a thermocouple (40) positioned to detect the temperature of the air as the latter leaves the oven cavity.

16 Claims, 6 Drawing Sheets

MICROWAVE OVENS AND METHODS OF COOKING FOOD

FIELD OF THE INVENTION

This invention relates to microwave ovens and to methods of cooking food, particularly cakes, in such ovens.

BACKGROUND OF THE INVENTION

Applicant's UK Patent Specifications Nos. 2127658A and 2137860A disclose microwave ovens having a magnetron for delivering microwave power to the oven cavity and a forced hot air system for delivering a forced flow of hot air through the oven cavity. Applicant's European Patent Specification No. 0239290 discloses a development where the cooking sequence (which is controlled by a microprocessor) is dependent on values measured during cooking, so compensating for variations between individual ovens. The results obtained by this development have been satisfactory, except when cooking cakes, certain types of which tend to be over-cooked while other types tend to be under-cooked. For example, madeira cakes and cakes like Black Forest gateaux tend to be over-cooked while heavier fruit cakes tend to be under-cooked. It is thought that over-cooking occurs because these cakes are cooked in a fairly short time and are subjected to too much microwave power proportionately, whereas the heavier cakes like fruit cakes are subjected to only just enough microwave power. The invention is directed to solving this problem. The invention also takes into account variations between cake mixes, variations in ambient temperature and while compensating for a hot or warm (as distinct from cold) starting temperature.

SUMMARY OF THE INVENTION

According to one aspect of the invention a microwave oven has a magnetron for producing microwave power in a cavity of the oven and a hot air system for producing hot air power by forced recirculation of air over an electrical resistance heating element, a temperature sensor for sensing the temperature of the recirculated air, a timer for timing cooking, a microprocessor responsive to the temperature sensor and the timer for controlling the magnetron and the hot air system whereby a food item is subjected to a first cooking stage during which hot air is applied but no microwave power is applied, a second cooking stage during which mrcowave power is applied but the electrical resistance heating element is not energized, and a third cooking stage during which at least hot air power is applied, the transitions between the stages being determined by the recirculated air temperature as detected by the temperature sensor and the microprocessor having stored therein a predetermined characteristic yielding the duration of the third stage.

Preferably, the recirculated air temperature is detected at a predetermined sampling time after the commencement of cooking, and the predetermined characteristic relates the duration of the third stage to the duration of the second stage and to the recirculated air temperature detected at the sampling time The end of the first stage may occur when the sensed recirculated air temperature reaches an upper threshold such as 170° C., and the commencement of the second stage may occur when the sensed recirculated air temperature falls to an intermediate threshold, such as 150° C. The transition from the second stage to the third stage may occur when the sensed recirculated air temperature falls to a lower threshold such as 100° C. or 105° C. At the commencement of the third stage, the microprocessor computes the remaining cooking time, and this time is preferably displayed, counting down to zero.

Microwave power may be applied from the commencement of the third stage and for a proportion of the time duration of the third stage, this proportion being stored in the microprocessor, the microwave power and hot air power being applied simultaneously during this proportion. Said proportion is preferably determined from a characteristic relating the time duration of the third stage and said proportion. Also, during the third stage the cavity temperature is preferably thermostatically controlled by means of a characteristic relating the time duration of the third stage to the maximum cavity temperature level to be reached during the third stage.

The predetermined sampling time may be one minute after the commencement of cooking.

The predetermined characteristic is preferably of the form $$T_3 = \frac{(T_2 + \text{numerical constant})}{T_2} \times f$$

where $T_2$=duration of the second cooking stage $T_3$=duration of the third cooking stage f=factor dependent on the detected recirculated air temperature at the predetermined sampling time The numerical constant is preferably ten (10), and the factor f is preferably derived by the microprocessor from a stored characteristic relating values of recirculated air temperature at the sampling time to values of f.

According to another aspect of the invention, a method of cooking a food item in a microwave oven having the facility of producing microwave power and hot air power by the forced recirculation of air over an electrical resistance heating element and through the oven cavity, comprises subjecting the food item to a first cooking stage during which hot air but no microwave power is produced, subjecting the food item to a second cooking stage during which mircowave power is produced but the element is not energized, and subjecting the food item to a third cooking stage during which at least hot air power is applied, the transitions between the stages being determined by the temperature of the recirculated air, and the duration of the third stage being determined from a predetermined characteristic yielding the duration of the third stage:

A preferred embodiment of microwave oven will now be described by way of example, with reference to the accompanying drawings, in which:

DESCRIPTION OF THE PREFERRED EMBODIMENTS

Figure 1:
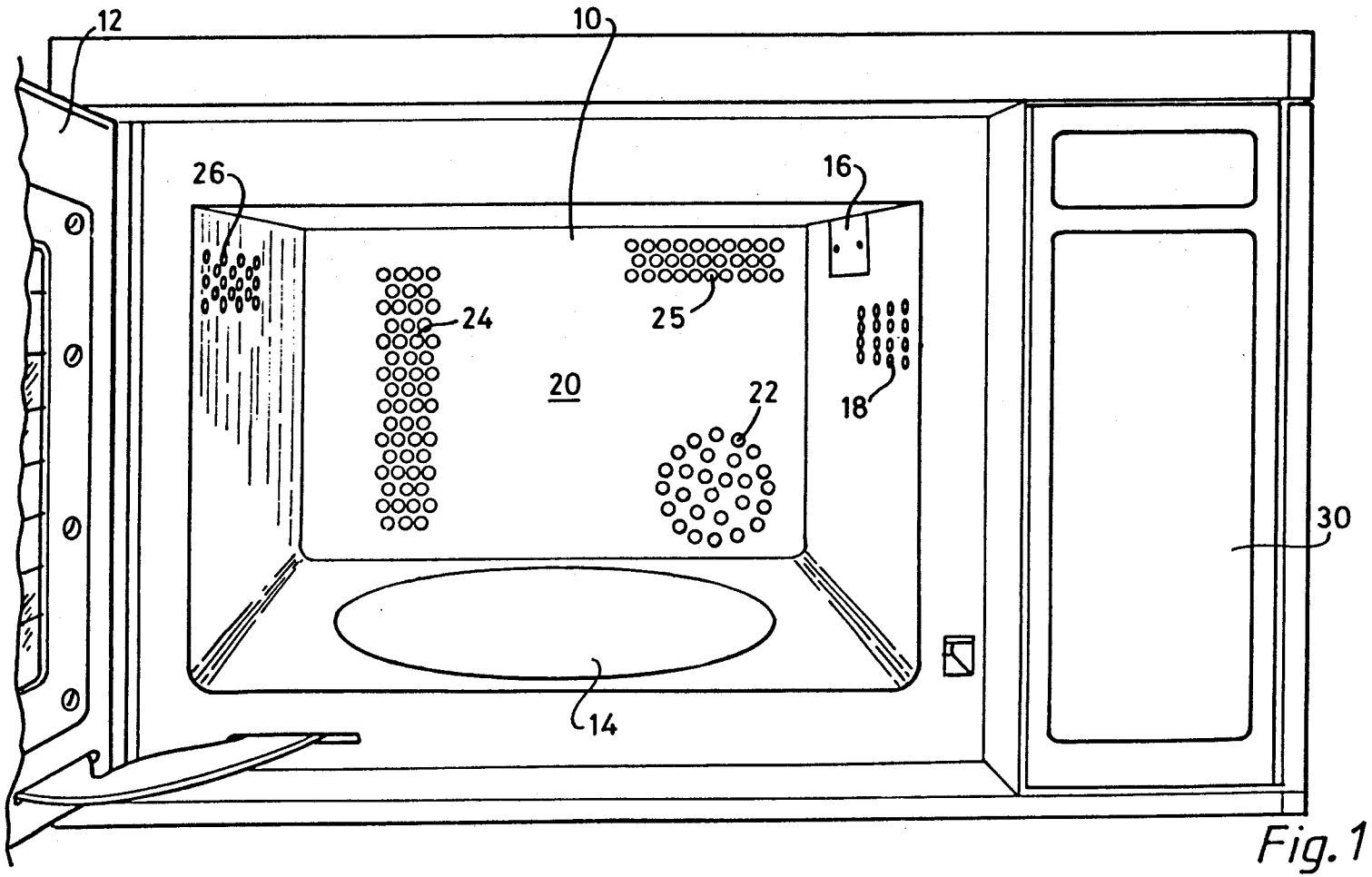
FIG. 1 is a front perspective view of the oven with an oven door open.

The oven is similar in construction and in circuit configuration to the ovens disclosed in the applicant's two aforementioned UK Patent Specifications. In particular, the oven has a food-receiving cavity 10 which is closable by a hinged front door 12 and in the base of which is located a rotatable turntable 14. A magnetron (not shown) delivers microwave power to the cavity through an inlet 16, and cooling air from a magnetron blower fan is capable of enetering the cavity through a perforated inlet 18. The rear panel 20 of the cavity has a perforated outlet aperture 22 and a perforated inlet aperture 24, these two apertures respectively serving for the exit and entry of forced air to the cavity. The cavity has a further vent 25, a perforated area 26 which is illuminated, and the front of the casing of the oven has a control panel 30.

Figure 2:
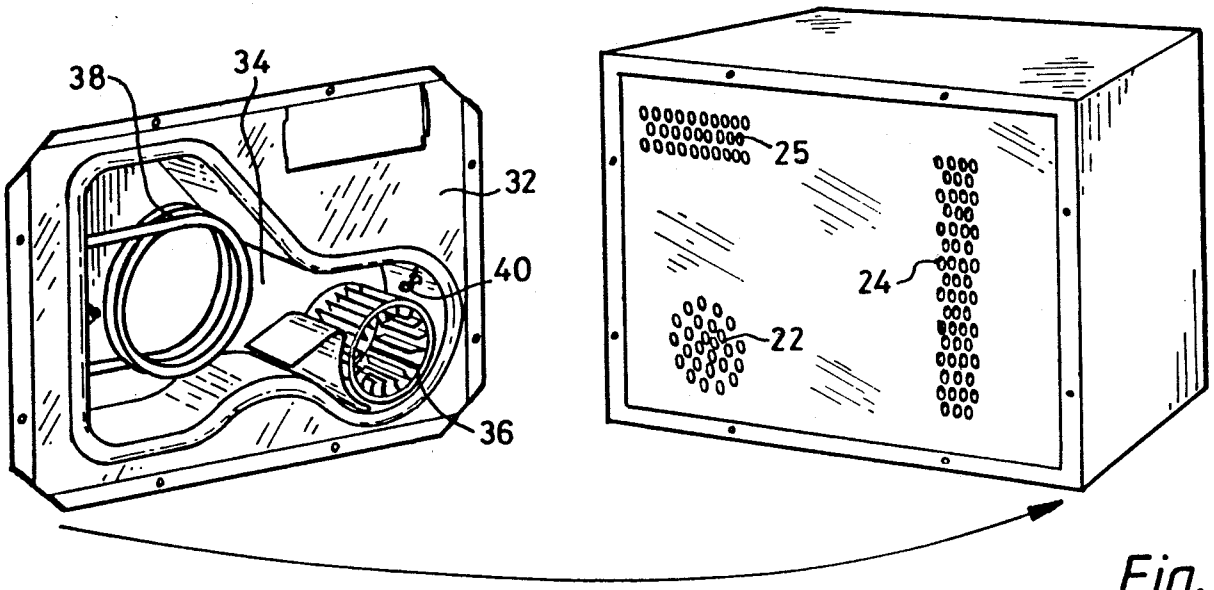
FIG. 2 shows the rear of the oven with a rear panel removed to show a hot air compartment of the oven.
Figure 3:
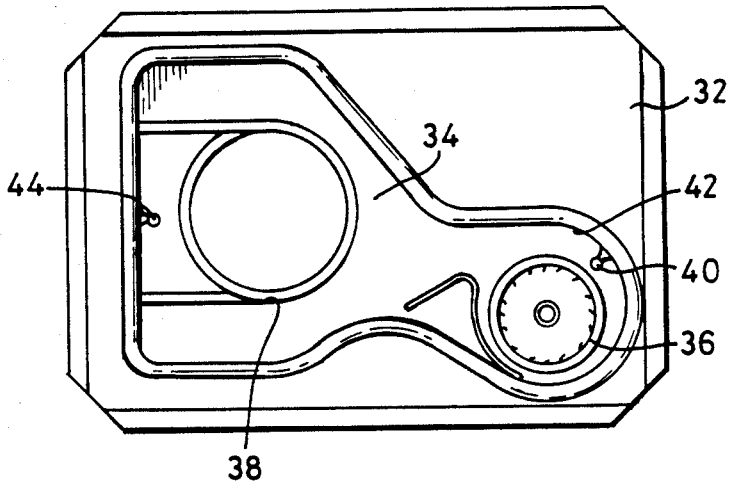
FIG. 3 is an elevation showing the casing and associated element defining the hot air compartment.

Referring to FIGS. 2 and 3, the rear of the oven has a casing 32 shaped to provide a hot air compartment 34 through which air passes behind the panel 20. Within the compartment 34 are located a fan 36, disposed behind the outlet aperture 22, and an electrical resistance heating element 38, disposed behind the inlet aperture 24. The fan 36 is rotatable about a horizontal axis and has around its periphery a plurality of impeller blades which draw air from the cavity 10, through the outlet aperture 22, and thence force the air over the electrical resistance heating element 38 where it is heated, before redirecting the air back into the cavity 10 through the inlet aperture 24.

A temperature sensor in the form of a thermistor bead 40 is located in the compartment 34 at a position spaced midway between the outer periphery of the blades of the fan 36 and the adjacent wall 42 defining the peripheral margin of the hot air compartment in this region. It will be seen from FIG. 3 that the thermistor bead 40 is located at an angle of about 45° from a vertical line passing through the rotational axis of the fan 36. A further thermistor bead 44 is located in a conventional position just downstream of the electrical resistance heating element 38. Signals from the two thermistor beads 40, 44 provide an accurate indication of cooking progress and the variations of temperature with time, as detected by each thermistor bead, and are used by the microprocessor of the oven in order to control the lengths and durations of the microwave power and hot air power, in a manner now to be described.

Figure 4:
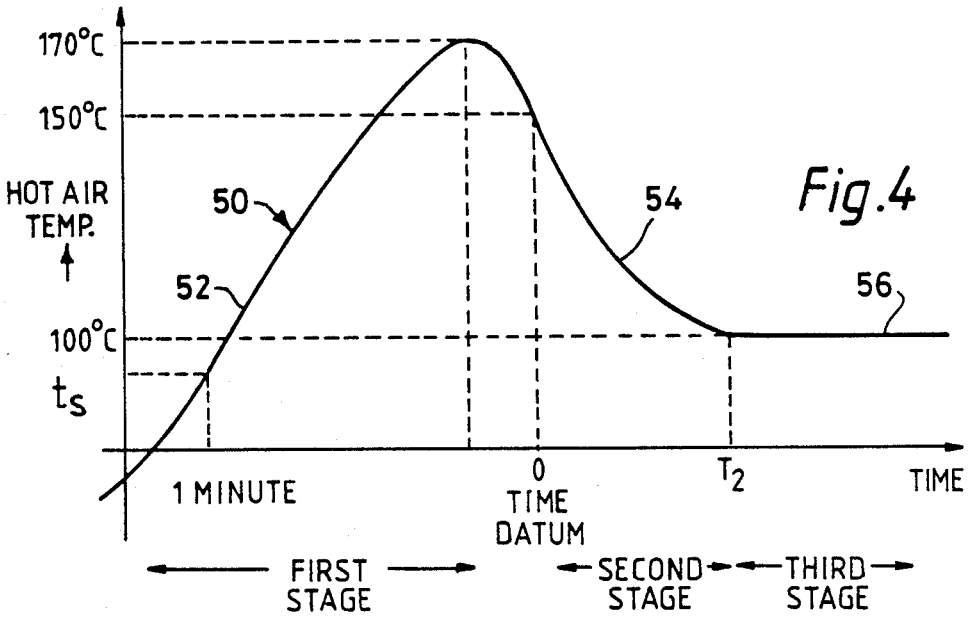
FIG. 4 is a graph showing the variation of hot air temperature with time, for a typical cooking procedure.

Referring to FIG. 4, the curve 50 shows the variations of recirculated aira temperature (or so-called "hot air temperature"), as detected by thermistor bead 40, plotted against time.

Figure 5:
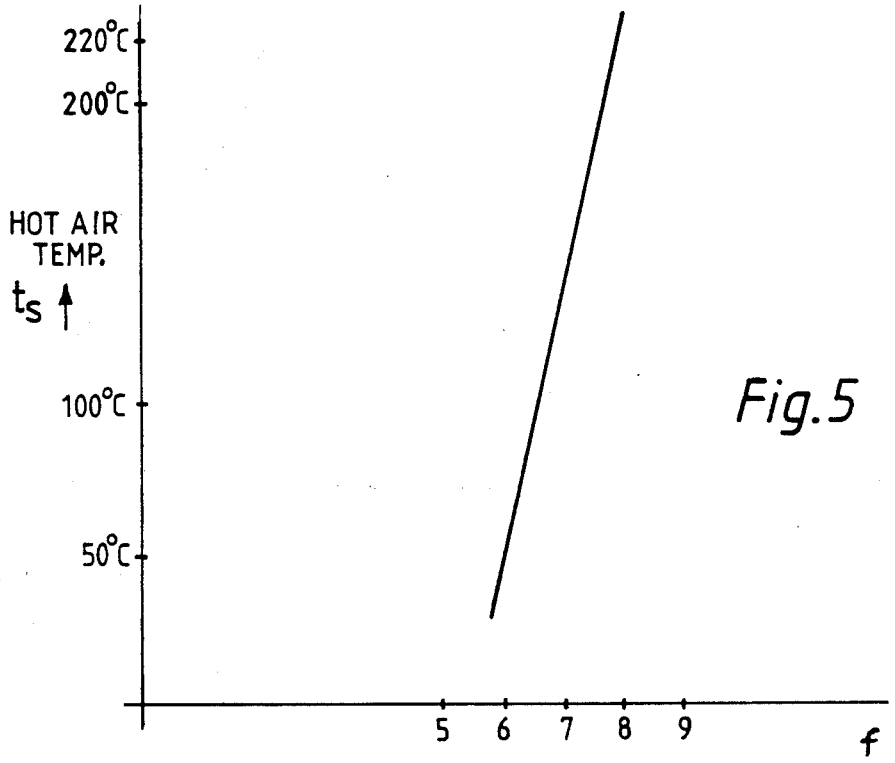
FIGS. 5 to 7 are graphs of the characteristics stored in the microprocessor of the oven.
Figure 6:
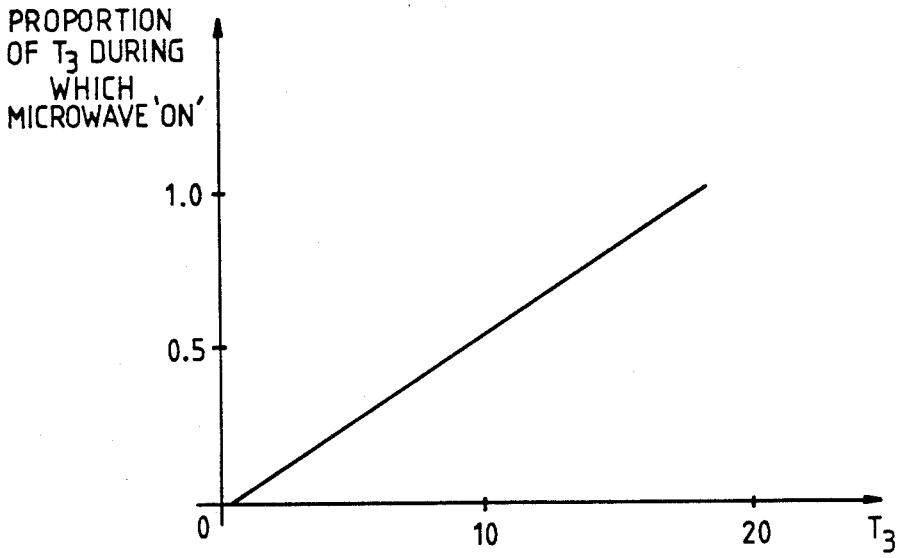
Figure 7:
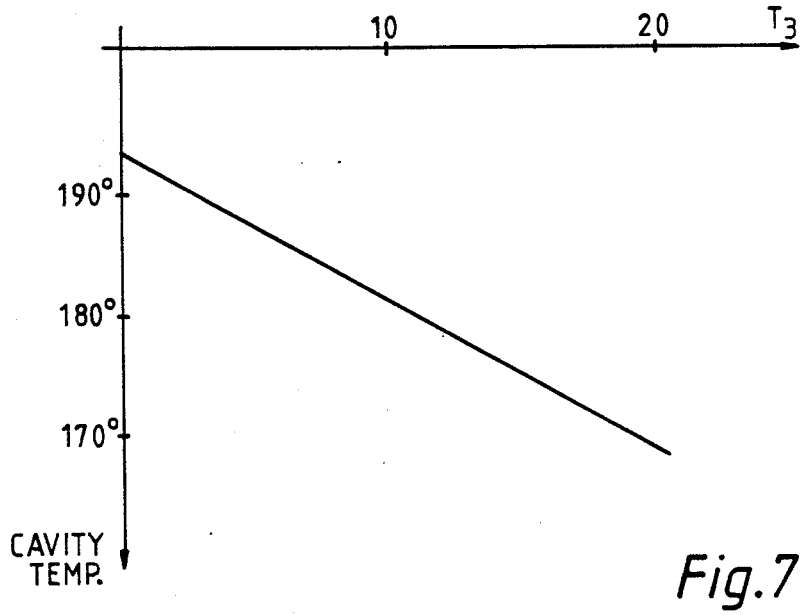

During the first stage 52 hot air power is applied but no microwave power is applied. At a predetermined sampling time of one (1) minute from commencement of cooking the hot air temperature $t_s$ as detected by thermistor bead 40 is registered in the microcomputer. From the detected value of the hot air temperature $t_s$ the microprocessor computes a corresponding value of factor f from FIG. 5, for a computation to be described later. When the sensed temperature reaches an upper threshold of 170° C. the microprocessor switches off the element 38, to mark the end of the first stage. The fan 36 remains in operation to circulate air through the cavity 10 and compartment 34. The hot air temperature now falls until an intermediate threshold of 150° C. is reached, at which point the magnetron is energized and the microprocessor timer is reset to zero to make time datum thereby marking the commencement of the second cooking stage 54. During the second stage 54 the sensed temperature falls until it reaches a lower threshold value such as 100° C. (or 105° C.) which marks the end of the second stage, computed from the time datum. At time $T_2$ the element 38 is re-energized and the microprocessor computes the remaining cooking time from the following predetermined characteristic or formula.

$$T_3 = \frac{(T_2 + 10)}{T_2} \times f$$

where $T_2$ is the duration of the second cooking stage 54, $T_3$ is the duration of the third cooking stage 56 (i.e. the remaining cooking time beyond $T_2$), and f is the factor derived from the characteristic of FIG. 5, relating values of $t_s$ to values of f Having computed the duration of the third cooking stage, the microcomputer determines from FIG. 6 the proportion of the third cooking stage, commencing from the start thereof at $T_2$, during which microwave power is energized. Also, from FIG. 7 the microprocessor computes the maximum cavity temperature, as determined by thermistor 44, which will prevail during the third cooking stage 56. Hence, during the third cooking stage 56 the cavity temperature is thermostatically controlled by selective energization or de-energization of the element 38 (the fan 36 remaining operative), in order to limit the maximum temperature as detected by the thermistor 44. The third cooking stage 56 is shown diagrammatically in FIG. 4. The end of the third cooking stage 56 marks the completion of cooking.

The fan 36 remains operative during the whole cooking process, but the element 38 is switched in the manner described selectively to apply hot air.

The oven may have the facility of giving a well done result or a lightly done result. If the user selects a lightly done result before the end of the second stage at $T_2$, the microprocessor multiplies $T_3$ (as calculated above) by 0.5 to give a new $T_3$, and reduces the maximum cavity temperature during the third stage by 20° C. If a well done result is selected before time $T_2$, the microprocessor multiplies $T_3$ by 1.3 to give a new $T_3$and increases the maximum cavity temperature during the third stage by 20° C.

If a lightly done result is selected by the user after time $T_2$, the microprocessor multiplies $T_3$ by 0.5 to give a new $T_3$ and limits the cavity temperature to 160° C. during the third stage. If a well done result is selected by the user after time $T_2$, the microprocessor multiplies $T_3$ by 1.5 to give a new $T_3$ and limits the cavity temperature to 250° C. during the third stage.

Figure 8:
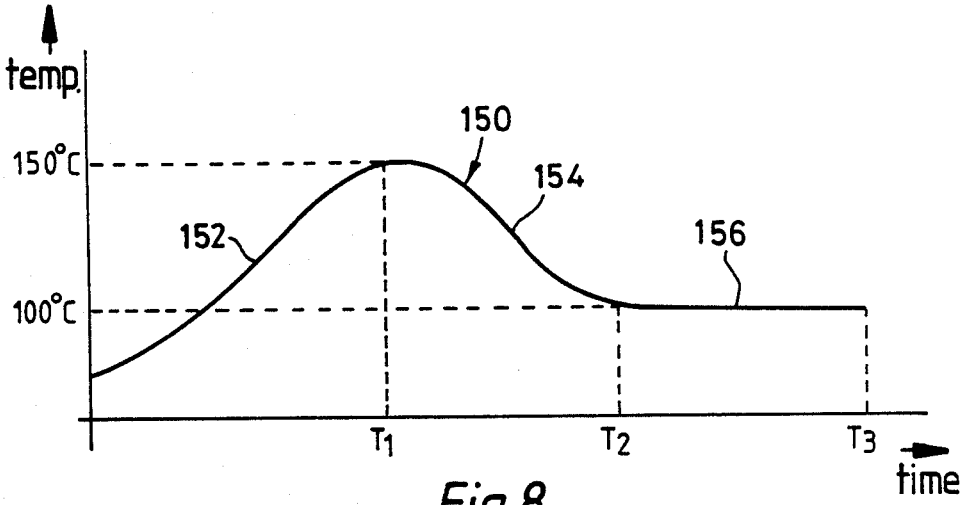
FIGS. 8 to 10 are graphs depicting modified characteristics.
Figure 9:
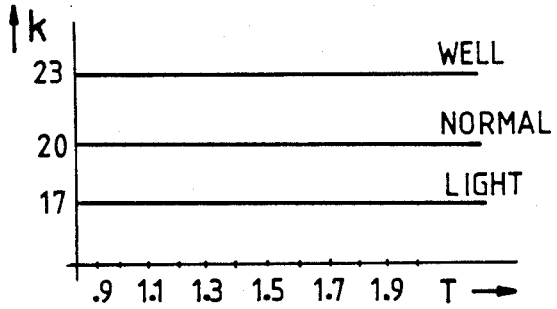
Figure 10:
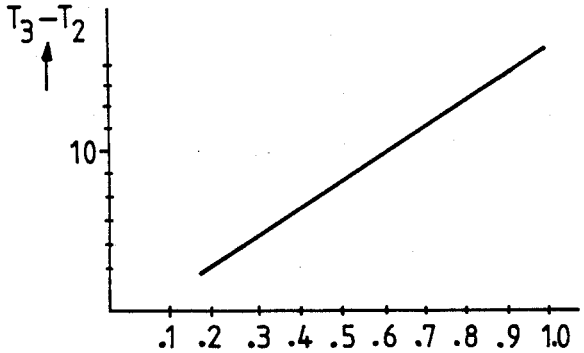

FIGS. 8 to 10 illustrate a modification in which the oven structure is as previously described but in which the microprocessor is differently programmed.

Referring to FIG. 8 the curve 150 shows the variation of hot air temperature, as detected by thermistor bead 40, plotted against time.

During the first stage 152 hot air power is applied but no microwave power is applied. When the sensed temperature reaches an upper threshold of 150° C. the microprocessor records the time T1 and the heating element is switched off and the microwave power is switched on. During the second stage 154 the sensed temperature falls until it reaches a lower threshold value such as 100° C. which marks the end of the second stage 154 at time T2. At time T2 the element is re-energised and the microprocessor computes the remaining cooking time by reference to a stored characteristic shown graphically in FIG. 9. The fan remains operative for the entire cooking process.

The horizontal axis in FIG. 9 shows the values of a temperature factor T which the microprocessor computes at time T2 from the following relationship:

$$T = \frac{T1}{T2 - T1}$$

The vertical axis of FIG. 9 represents a factor k by which the value of T must be multiplied to determine the total cooking time T3. Hence, when time T2 is reached the microprocessor computes the value of the factor T and from the characteristic of FIG. 9 computes the total cooking time T3. By substracting T2 from T3 the microprocessor obtains the duration of the third cooking stage 156 and this time is displayed, counting down to zero. The graph of FIG. 9 has three lines respectively corresponding to a well done result, a "normal" result and a lightly done result. The oven has touch pads enabling the user to select one of these three possibilities, the microprocessor then using the appropriate characteristic in computing T3.

It has been found advantageous to vary the amount of microwave power in the third cooking stage 156 in dependence on the duration of the third stage. This is done by reference to a further stored characteristic shown diagrammatically in FIG. 10. The vertical axis in FIG. 10 represents the calculated duration of the third stage 156, which is T3 minus T2. The horizontal axis in FIG. 10 represents the proportion of the third stage during which microwave power is switched on, commencing from the start of the third stage. For example, a third stage duration of 10 minutes is equivalent to a microwave on proportion of 0.6, meaning that microwave power would be switched on for the first six (6) minutes of the third stage 156. Thus microwave power and hot air power would be on simultaneously for the first six (6) minutes of the third stage 156, the final four (4) minutes being hot air power only.

This cooking process has been found to give excellent results with all types of cakes.

In addition to a rotatable turntable, the oven by have a wire rack which rests on the turntable, as disclosed in applicant's European Patent Specification No: 0132080. Food may be placed on the wire rack and/or the turntable. The oven may have the facility of detecting whether a cake is on the wire rack or on the turntable, and then following a cooling program appropriate to the detected position. For example, the microprocessor may be programmed to compute a total cooking time from the formula.

$$\text{Total cooking time} = \frac{T2 \times S}{T2 - T1}$$

Where S is a factor which is preferably ten (10) if the cake is detected as being on the turntable, and eleven (11) if the cake is detected as being on the wire rack. The position of the cake is detected by the following two-fold test. If $T_2$is less than 12.5 mins, and if $(T_2 - T_1)$ is less than 5.0 mins the cake is detected as being on the turntable. If these two conditions are not both satisfied, the cake is assumed to be on the wire rack.

I claim:

1. A method of cooking cakes or the like using a microwave oven with an integral hot air system comprising the steps of:

recirculating air through a cooking cavity in the microwave oven throughout a cooking period including first, second and third cooking stages;

sensing the temperature of the recirculating air throughout the cooking period;

causing heated air to flow into the microwave oven in said first cooking stage;

terminating the flow of heated air into the microwave oven by sensing a predetermined upper threshold temperature for the recirculating air;

initiating microwave power into the microwave oven when the temperature of the recirculating air has fallen to a predetermined intermediate temperature to commence said second cooking stage;

reinitiating the flow of heated air into the microwave oven when said temperature of said recirculating air falls to a predetermined lower value to commence said third cooking stage; and determining the duration of said third cooking stage based on selected temperature and duration parameters in said cooking stages so that the cakes or the like are neither undercooked nor overcooked.

2. A method of cooking as claimed in claim 1, wherein the step of determining the duration of said third stage cooking further comprises the steps of:

detecting the temperature of said recirculating air at a predetermined sampling time after the commencement of said first cooking stage; and using the temperature of said recirculating air at said predetermined sampling time and a measure of the time duration between the sensing of said predetermined intermediate temperature and said predetermined lower value for said temperature of said recirculating air to calculate said duration of said third cooking stage.

3. A method of cooking according to claim 2, wherein said predetermined sampling time is one (1) minute after the commencement of said first cooking stage.

4. A method of cooking as claimed in claim 2 wherein said third cooking stage further comprises the steps of:

ascertaining a desired proportion of the duration of said third cooking stage that said microwave power shall remain operational; and shutting off said microwave power after said proportion of said remaining cooking time has passed.

5. A method of cooking as claimed in claim 4 wherein said third cooking stage further comprises the step of maintaining said recirculating air passing through said cooking cavity at a predetermined maximum temperature level based upon the duration of said third cooking stage.

6. A method of cooking as claimed in claim 5 further comprising the steps of:

selecting a different cooking result during said second cooking stage or early in said third cooking stage; and adjusting said duration of said third cooking stage and said maximum temperature level to obtain said different cooking result.

7. A method of cooking a food item in a microwave oven having the facility of producing microwave power and hot air power by the forced recirculation of air over an electrical resistance heating element and through the oven cavity, comprising the steps of:

subjecting the food item to a first cooking stage during which recirculated hot air but no microwave power is used;

subsequently subjecting the food item to a second cooking stage during which microwave power is used and the air through the oven cavity is recirculated but said heating element is not energized; and finally subjecting the food item to a third cooking stage during which at least recirculated hot air power is applied, the transitions between said cooking stages being determined by the temperature of the recirculated air, the duration of said third stage being a function of the duration of said second cooking stage and a predetermined value that is a function of the temperature of the recirculating heated air at a specified time during said first cooking stage.

8. A microwave oven with an integral hot air system comprising:

means for recirculating air through a cooking cavity in the microwave oven throughout a cooking period including first, second and third cooking stages;

means for sensing the temperature of the recirculating air throughout the cooking period;

means for causing heated air to flow through the microwave oven in said first cooking stage;

means for terminating the flow of heated air into the microwave oven when a predetermined upper threshold temperature for the recirculating air is sensed;

means for initiating microwave power into the microwave oven when the temperature of the recirculating air has fallen to a predetermined intermediate temperature to commence said second cooking stage;

means for reinitiating the flow of heated air into the microwave oven when said temperature of said recirculating air falls to a predetermined lower value to commence said third cooking stage; and means responsive to selected temperature and duration parameters in said cooking stages for determining the duration of said third cooking stage.

9. A microwave oven according to claim 8, wherein said means for determining the duration of said third cooking stage comprises a microprocessor using a formula of the form $$T_3 = \frac{(T_2 + \text{numerical constant})}{T_2} \times f$$

where $T_2$=duration of the second cooking stage $T_3$=duration of the third cooking stage f=factor dependent on the detected recirculated air temperature at the predetermined sampling time.

10. A microwave oven according to claim 9, wherein the factor f is derived by said microprocessor from a stored characteristic relating values of recirculated air temperature at said sampling time.

11. A microwave oven as claimed in claim 8, wherein said means for determining the duration of said third cooking stage further comprises:

means for detecting the temperature of said recirculating air at a predetermined sampling time after the commencement of said first cooking stage; and means for using the temperature of said recirculating air at said predetermined time and a measure of the time duration between sensing said predetermined intermediate temperature and said predetermined lower value for said temperature of said recirculating air to calculate said duration of said third cooking stage 12. A microwave oven according to claim 11, wherein at the commencement of said third cooking stage, when said duration is computed as a remaining cooking time of said third cooking stage, and further comprising means for displaying the remaining cooking time, said means for displaying the further cooking time counting the remaining cooking time down to zero.

13. A microwave oven as claimed in claim 11 wherein said means for using the temperature of said recirculating air at said predetermined sampling time and a measure of the time duration between sensing said predetermined intermediate temperature and said predetermined lower value for said temperature of said recirculating air to calculate said duration of said third stage cooking stage further comprises:

means for ascertaining a desired proportion of the duration of said third cooking stage in said microwave power shall remain operational; and means for shutting off said microwave power after said proportion of said remaining cooking time has passed.

14. A microwave oven as claimed in claim 13 further comprising means for maintaining said recirculating air passing through said cooking cavity at a predetermined maximum temperature level durtion said third cooking stage based upon the duration of said third cooking stage.

15. A microwave oven as claimed in claim 14 further comprising:

means for selecting a different cooking result during said second cooking stage or early in said third cooking stage; and means for adjusting said duration of said third cooking stage and said maximum temperature level to obtain said different cooking result.

16. A microwave oven according to claim 11, wherein said predetermined sampling time is one (1) minute after the commencement of said first cooking stage.

* * * * *